US005829549A

United States Patent [19]

Flynn

[11] Patent Number: 5,829,549

[45] Date of Patent: Nov. 3, 1998

[54] WALKWAY WITH RAIL SYSTEM

[76] Inventor: Richard A. Flynn, P.O. Box 830, Island Lake, Ill. 60042

[21] Appl. No.: 712,640

[22] Filed: Sep. 11, 1996

[51] Int. Cl.[6] ..... E04G 5/06

[52] U.S. Cl. ..... 182/82; 182/150; 182/45

[58] Field of Search ..... 182/82, 150, 206, 182/113, 45; 248/214, 235, 250

[56] References Cited

U.S. PATENT DOCUMENTS

| | | | |
|---|---|---|---|
| 3,314,567 | 4/1967 | Shoemaker | 182/150 X |
| 3,510,097 | 5/1970 | McCaleb | 182/150 X |
| 3,515,244 | 6/1970 | Weible | 182/150 |
| 3,848,854 | 11/1974 | De Barbieri | 256/65 |
| 3,880,405 | 4/1975 | Brueske | 256/59 |
| 4,467,888 | 8/1984 | Hickling | 182/19 |
| 4,666,131 | 5/1987 | Kettelkamp, Sr. et al. | 256/59 |
| 4,782,914 | 11/1988 | Nail | 182/113 |
| 4,787,475 | 11/1988 | Arteau et al. | 182/82 |
| 4,984,654 | 1/1991 | Anderson | 182/179 |
| 5,259,477 | 11/1993 | Fears et al. | 182/82 |
| 5,295,557 | 3/1994 | Taylor | 182/222 |
| 5,503,358 | 4/1996 | Lapp | 182/82 X |
| 5,515,941 | 5/1996 | Palmer et al. | 182/45 |
| 5,524,727 | 6/1996 | Yennie, Jr. | 182/150 X |

FOREIGN PATENT DOCUMENTS

| | | | |
|---|---|---|---|
| 405059809 | 3/1993 | Japan | 182/150 |

*Primary Examiner*—Ramon O. Ramirez
*Assistant Examiner*—Long Dinh Phan
*Attorney, Agent, or Firm*—Chase & Yakimo

[57] ABSTRACT

A walkway system for roof, truss or elevated workers or the like is attached to a structure, e.g. a building wall of an unfinished building. The system utilizes first and second longitudinally spaced-apart support assemblies for releasable attachment to a top of a building wall. Each assembly presents a depending support bar extending along an exterior surface of a building wall. A horizontal support brace is attached to each depending support bar at selectable positions therealong, the horizontal support brace providing support for overlying boards of a walkway. Attached to the free end of the horizontal support brace is a vertical post having a plurality of vertically spaced-apart brackets thereon for receiving a portion of a plurality of vertically spaced-apart hand rails therein. A series of hook-like brackets are releasably placed along the rails for positioning a reinforcing strut adjacent each hand rail. The walkway can be vertically offset from the top of the building wall as well as laterally extended therefrom. The walkway with reinforced hand rails is effective in presenting a barrier to preclude workers from falling onto the ground.

22 Claims, 8 Drawing Sheets

WALKWAY WITH RAIL SYSTEM

BACKGROUND OF THE INVENTION

This invention relates to a worker's safety system and, more particularly, to a scaffold system releasably engageable with a building wall or other building structure so as to present a walkway with a hand rail barrier.

During building construction, particularly on trusses and/or roofs, it is desirable to provide a safety system to protect workers who may slide off the trusses, roof or other slanted areas. Such a safety concern is a burgeoning one as such accidents usually lead to debilitating injuries. Although various forms of safety systems have been shown in the disclosed prior art references, such references do not provide a walkway system which adjusts the vertical offset of the walkway from the top of the supporting surfaces as well as the lateral extent of the walkway from the support surface, the walkway having a reinforced guard rail system.

In response thereto I have invented a safety system which utilizes a first bracket assembly having a depending vertical support releasably engageable with a top of a building wall or the like. Attached to the depending vertical support is a horizontal walkway support underlying the walkway support surface. At one end of each walkway support is a vertical hand rail support member releasably engageable with the walkway support and adjustable therealong. Each vertical hand rail support has a plurality of brackets thereon for receiving a portion of a wooden hand rail therein. Releasably attached to these wooden hand rails are a plurality of brackets for receiving a portion of a supplemental strut adjacent the first hand rail so as to reinforce the same. A reinforced barrier, spaced from the building, is thus presented which can better resist the forces of a worker who may slide off the roof or truss and fall on the walkway and/or such barrier. My system is thus releasably engageable to a vertical building wall or the like so as to prevent a safe walkway system as bounded by the hand rail barrier.

It is therefore a general object of this invention to provide a walkway with rail system which protects persons, working at elevated positions, e.g. roofs, trusses or the like from serious injuries.

Another object of this invention is to provide a system, as aforesaid, which allows workers to work on roofs without the fear of falling.

Another object of this invention is to provide a system, as aforesaid, which presents a walkway, the lateral extent of the walkway being adjustable.

A further object of this invention is to provide a system, as aforesaid, having a reinforced hand rail system vertically extending from the walkway.

Another particular object of this invention is to provide a system, as aforesaid, wherein the vertical offset of the walkway, relative to the top of the supporting structure, can be adjusted.

A further object of this invention is to provide a system, as aforesaid, wherein the base hand rail assembly, as selectably spaced from the supporting structure, can be reinforced.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
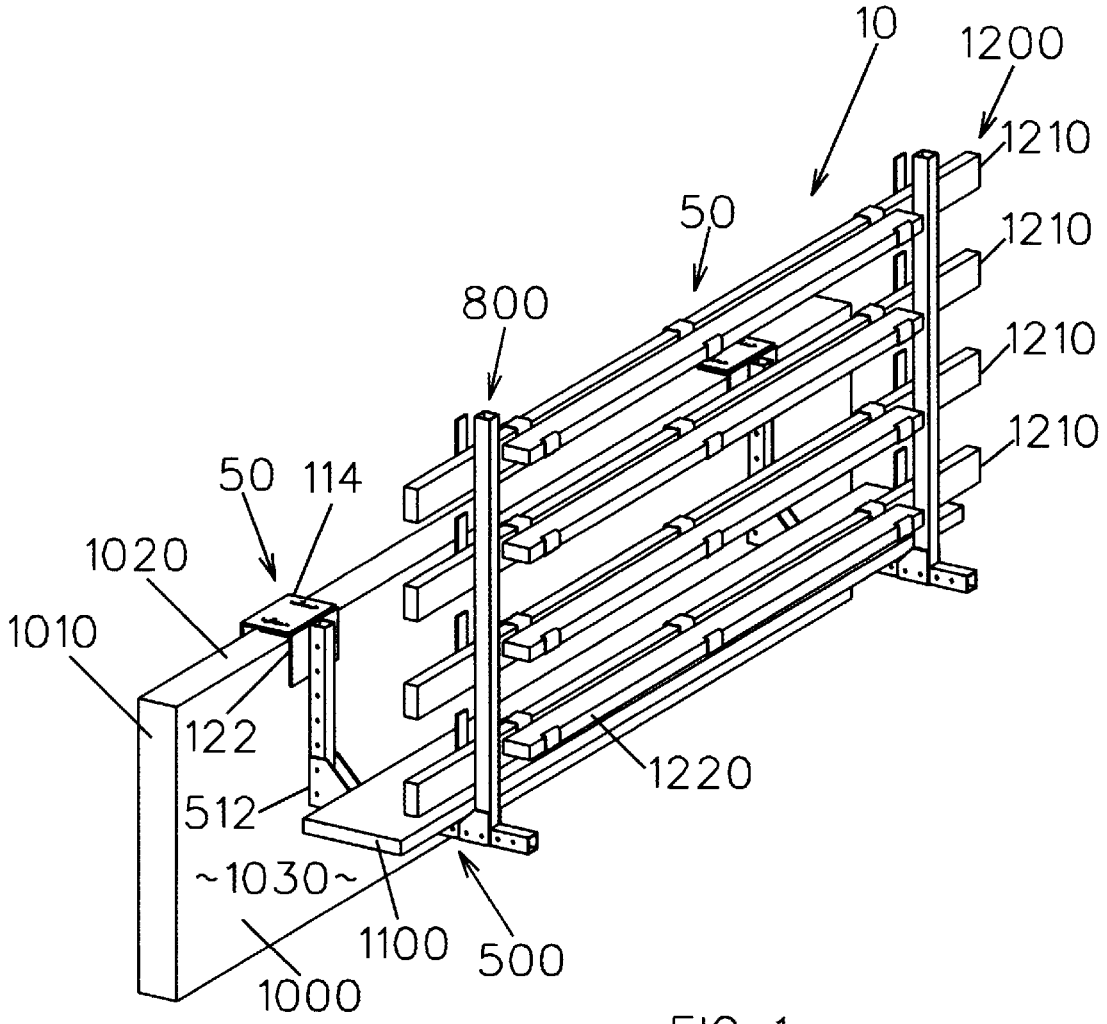
FIG. 1 is a perspective view of the walkway with rail system as attached to a vertical wall of a building, the wall being diagrammatically shown.
Figure 2:
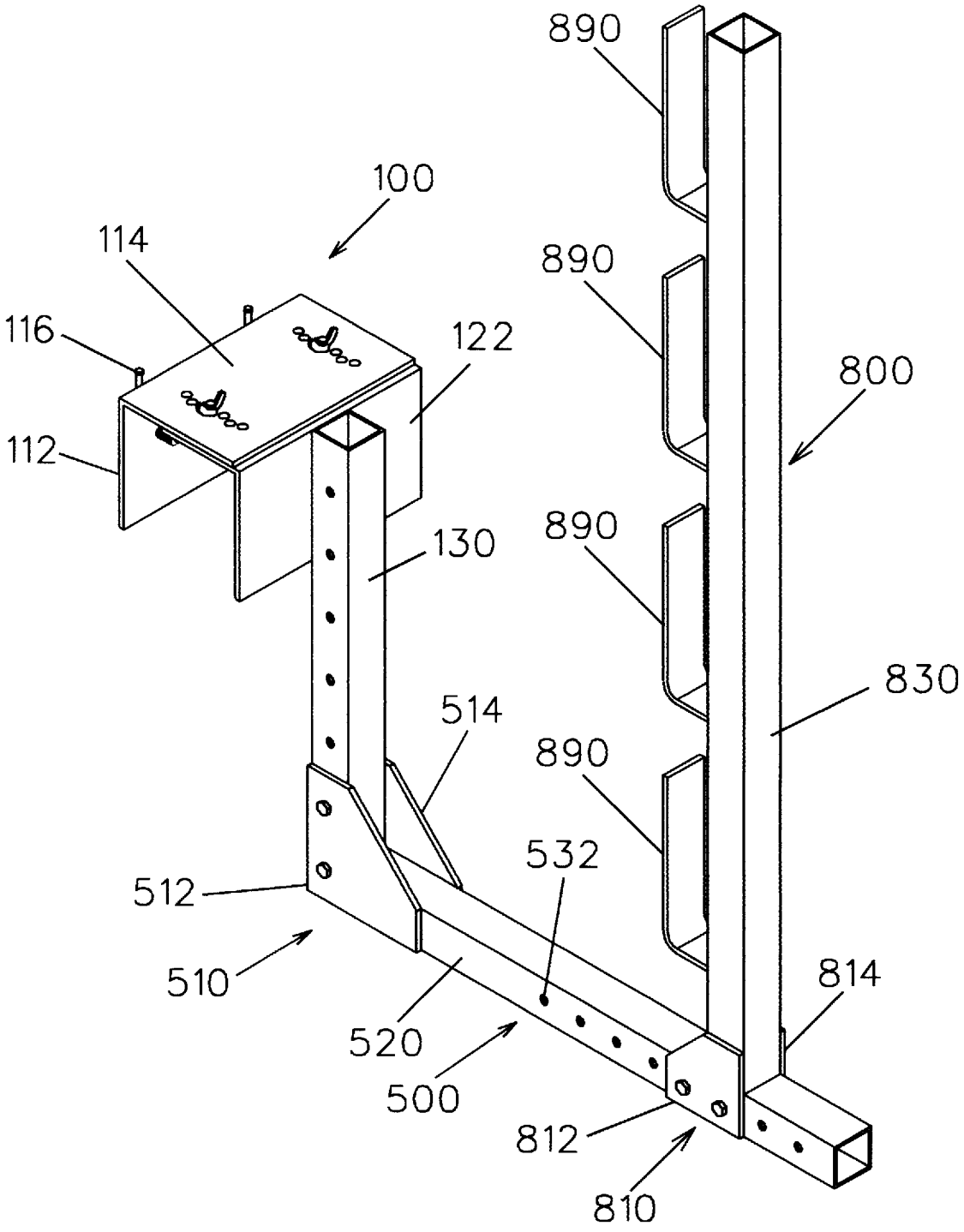
FIG. 2 is a perspective view, on an enlarged scale, of one support assembly utilized in the walkway system, as aforesaid, prior to installation of the walkway and hand rail boards.

Turning more particularly to the drawings, FIG. 1 shows the system 10 as generally comprising first and second longitudinally spaced-apart support assemblies 50 suspended from a building wall 1000, the assemblies having a walkway 1100 and hand rail barrier 1200. Each assembly 50 comprises a first building support assembly 100 for attachment to the top of a vertical building wall 1000 or the like, a walkway support assembly 500 attached to the building support assembly 100 and a vertical hand rail support assembly 800 attached to the walkway support assembly 500.

Figure 3:
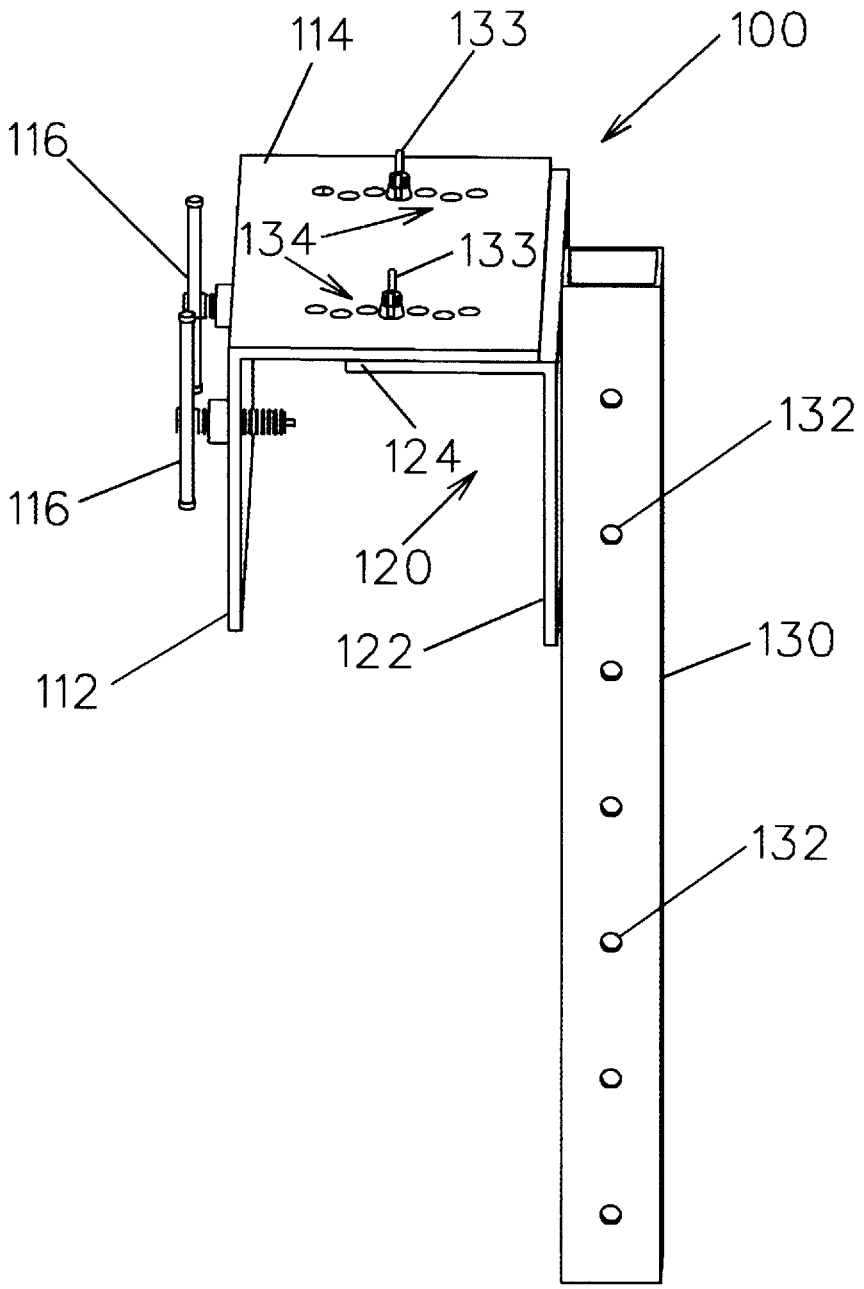
FIG. 3 is an end view of the building support assembly of the walkway system as aforesaid.
Figure 4:
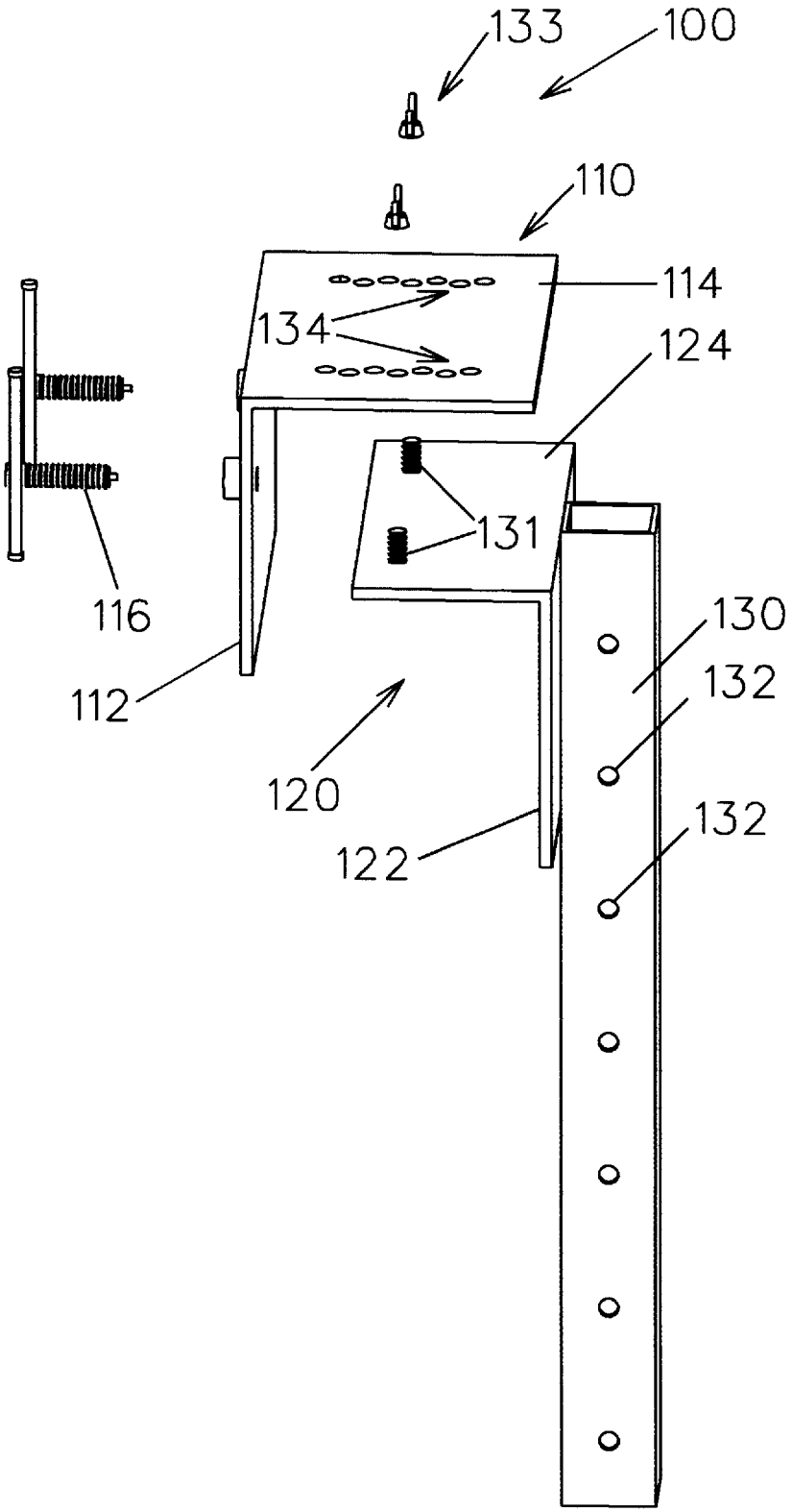
FIG. 4 is an exploded view of the assembly of FIG. 3.
Figure 5:
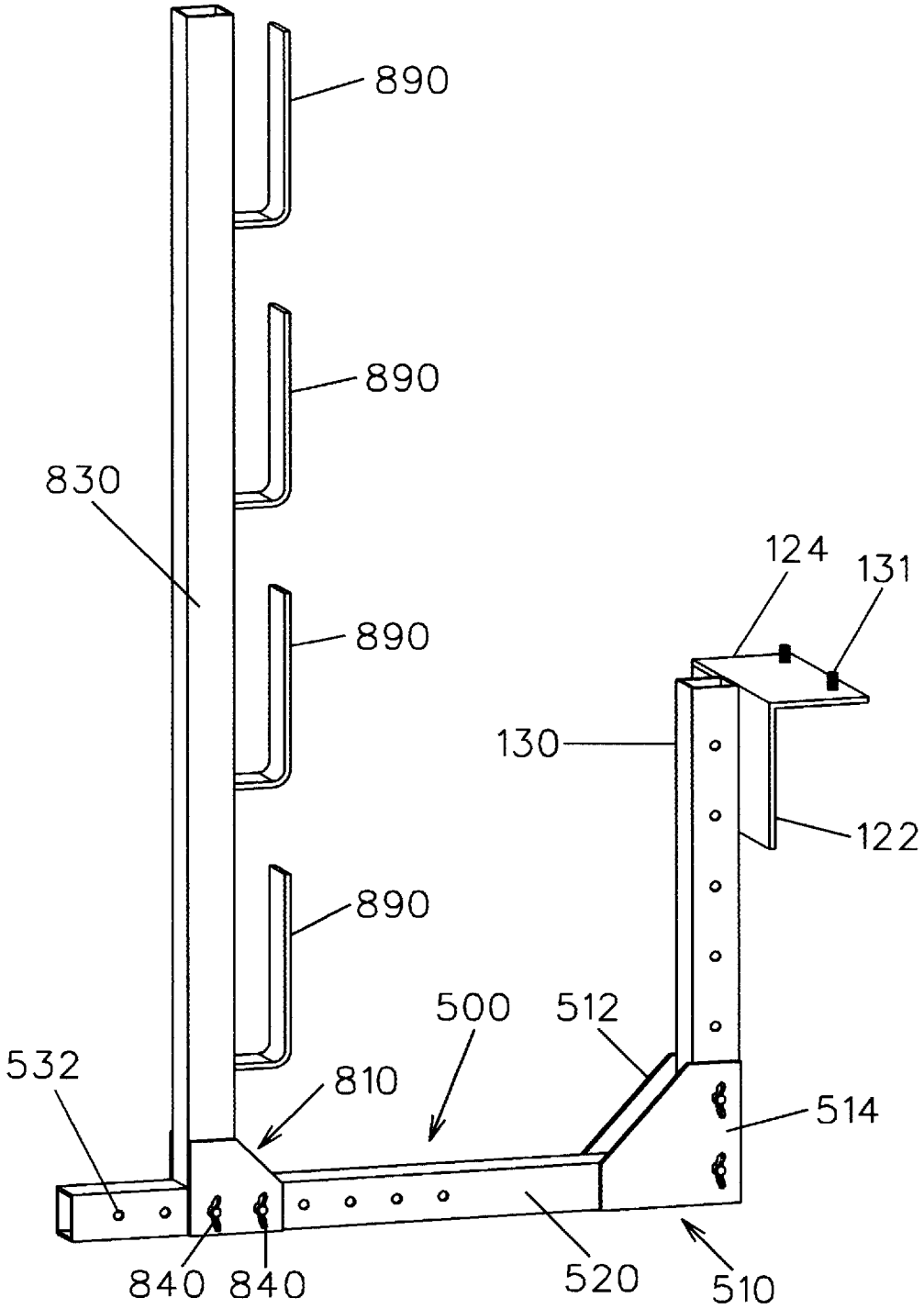
FIG. 5 is a view of the FIG. 2 assembly from the opposed end thereof.
Figure 6:
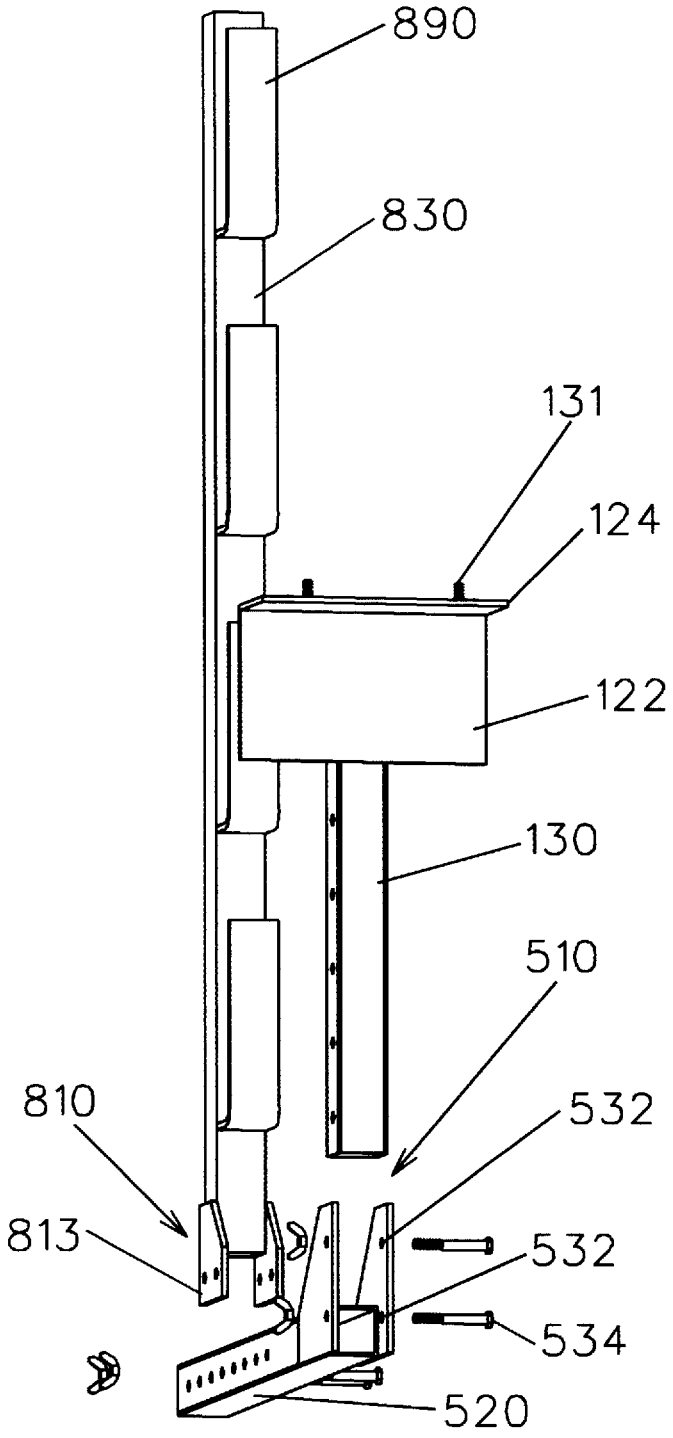
FIG. 6 is a rear exploded view of the assembly of FIG. 2.
Figure 7:
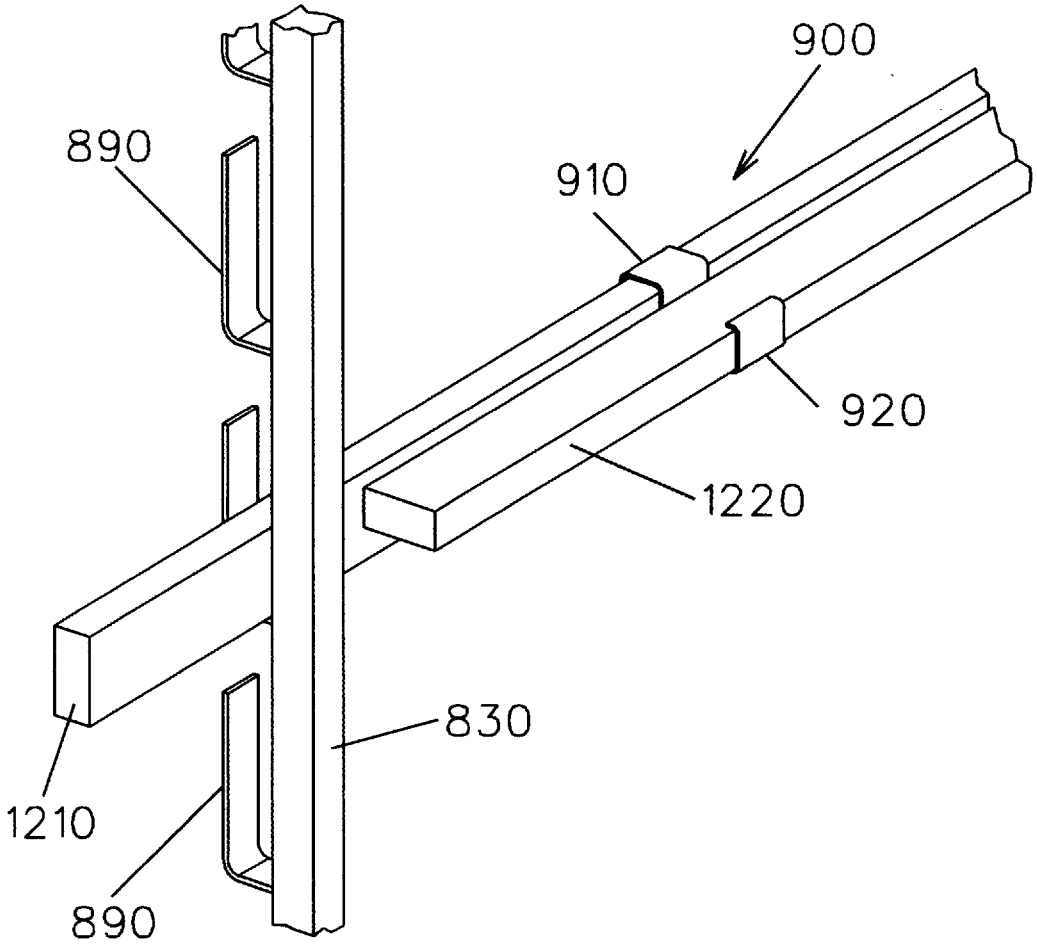
FIG. 7 is a fragmentary view showing the installation of a portion of one hand rail into the hand rail support assembly on an enlarged scale.

As shown in FIGS. 3 and 4, the building support assembly 100 is shown for attachment to atop a building wall 1000 or other horizontal structure, it being understood the assembly 100 could be adapted for attachment to other types of building structures.

This building support assembly 100 comprises a first bracket 110 having a depending wall 112 and a top horizontal wall/plate 114 normal thereto. Depending wall 112 is adapted to lie adjacent the inside vertical surface 1010 of the building wall 1000 and is attached thereto by clamping screws 116 such that wall 114 spans the top 1020 of the building wall 1000.

The horizontal wall 114 overlies a plate 124 of bracket 120 which is attached to a depending vertical support wall 122 which is adapted to lie adjacent the exterior surface 1030 of wall 1000. A vertical support 130 is attached to the depending wall 122 and likewise extends along building wall surface 1030. The relationship between plates 114 and 124 is adjustable by means of bolts 131 upwardly extending from plate 124, the bolts 131 extending through selected apertures 134 found along the width of the plate 114. Nuts 133 engage the free ends of bolts 131. Thus, the walls 112, 122 of bracket 100 assembly can be attached to the opposed surfaces of walls of various thicknesses.

Attached to the bottom of the depending vertical support 130 is a walkway support assembly 500 generally comprising a bracket 510 having a pair of walls 512, 514 with an attached support brace 520 horizontally extending therefrom. A pair of apertures 532 within each of the plates 512, 514 of bracket 510 are aligned with apertures 132 in the vertical support 130. Bolt/nut combinations 534 extend through these aligned apertures 132, 532. Thus, the position of bracket 510 along the vertical support 130 is adjustable. In turn, the vertical offset of brace 520, relative to the top 1020 of wall 1000, is likewise adjustable.

Attached to the free end of support brace 520 is a hand rail support assembly 800, this assembly 800 comprising a vertical support 830 extending from a bracket 810 consisting of first and second plates 812, 814 at the lower end thereof. Apertures 813 within bracket plates 812, 814 are aligned with apertures 532 in brace 520 for insertion of bolt/nut combinations 840 therethrough. Accordingly, the lateral distance of the vertical support 830 from the support assembly 100 and building wall 1000 surface 1030 can be selectably adjusted.

Two bracket assemblies 50, as above described, are installed at eight-feet intervals along the building wall 1000. Subsequently, a horizontal board 1100 is laid atop the braces 520 so as to present a reinforced walkway 1100. 2'×4' boards 1210 are then installed in the brackets 890 vertically spaced along the extent of support 830 so as to present a plurality of vertically spaced-apart hand rails 1210. Accordingly, these hand rails 1210 present a barrier 1200 bounding walkway 1100. This barrier 1200 will resist the forces produced by any workers sliding down the roof and onto the walkway 1100 as well as presents a safe hand rail system for persons walking along the walkway 1100 proper.

Figure 8:
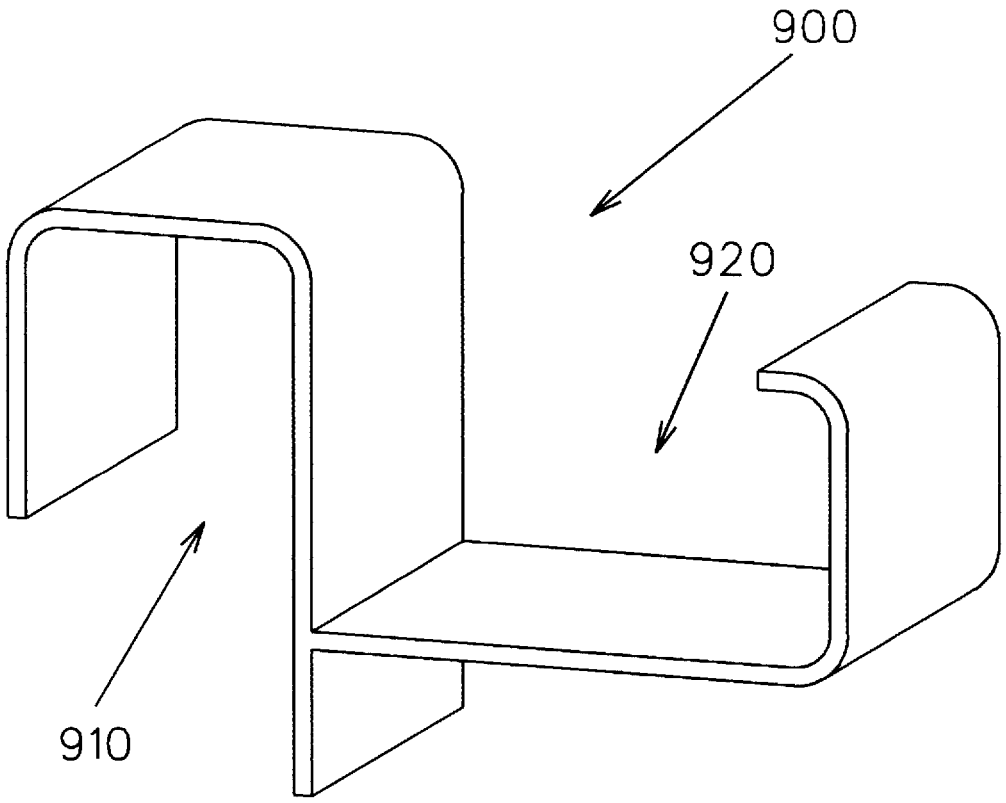
FIG. 8 is a view, on an enlarged scale, showing one of the reinforcing hand rail brackets for releasable installation along the length of a hand rail.

To further reinforce the hand rails 1210, a plurality of hand rail brackets 900 (FIG. 8) are installed along the extent of each hand rail 1210 and between the vertical hand rail support bars 830. The brackets 900 present first and second hook portions 910, 920. Depending hook portion 910 is adapted to releasably engage the top of hand rail 1210 with the opposed hook portion 920 adapted to receive a second 2'×4' board 1220 in a normal relationship adjacent the primary hand rail 1210. This strut 1220 reinforces the primary hand rail 1210 so as to further reinforce the barrier 1200 and resist any forces acting thereon.

Accordingly, it can be seen that my system 10 efficiently presents a safe walkway system bounded by a barrier 1200 which is easily attached to a building wall 1000 and vertically and laterally offset therefrom. It is also understood that my system may be adapted for connection to building structures other than a wall 1200 so as to present its accompanying advantages and results.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by letters patent is as follows:

1. A walkway system comprising:

first and second building support assemblies for attachment to a top of a building surface, each of said support assemblies presenting a depending support adapted to extend along an exterior portion of the building surface;

means for releasably engaging said building support assemblies to the building surface;

a pair of horizontal support braces for providing underlying support to a walkway; means for attaching each horizontal support brace at a selected position along each said depending vertical support whereby to adjust the vertical offset of the walkway from a top of the building surface;

a pair of hand rail support bars for attaching a portion of at least one hand rail thereto;

means for mounting each hand rail support bar at a selectable position along a length of each said horizontal support brace; and at least one hand rail;

means on each said hand rail support bar for releasably engaging a portion of said at least one hand rail therein, wherein to present a horizontal walkway extending along the building surface bounded by said hand rail.

2. The system as claimed in claim 1 wherein each building support assembly comprises:

a first bracket assembly comprising:

a first depending flange adapted to extend along an interior surface of a building wall;

a second flange extending from said first flange and adapted to lie adjacent a top of a building wall;

a second bracket assembly attached to said second flange and having said depending support attached thereto;

fastener means extending through said first flange of said first bracket assembly and into an interior surface of the building wall.

3. The system as claimed in claim 2 wherein said second bracket assembly comprises:

a first flange adapted to extend along a top surface of a building wall and adjacent said second flange of said first bracket assembly;

a second flange depending from said first flange and attached to said depending support; and fastener means on said first flange of said second bracket assembly for releasably attaching said second flange of said first bracket assembly to said first flange of said second bracket assembly.

4. The system as claimed in claim 3 further comprising means on said flanges of said first and second bracket assemblies for adjusting a lateral relationship between said depending flanges of said first and second bracket assemblies.

5. The system as claimed in claim 4 wherein said depending flange adjusting means comprises a plurality of apertures in said second flange of said first bracket assembly, said fastener means of said second bracket assembly extending through selectable apertures of said plurality of apertures in said first bracket assembly.

6. The system as claimed in claim 1 wherein said attachment means for each horizontal support brace comprises:

a bracket at an end of said horizontal support brace;

at least one aperture in said bracket;

a plurality of apertures along said depending support of said building support assembly;

fastener means extending through said bracket aperture and one selected aperture of said plurality of apertures along said depending support.

7. The system as claimed in claim 6 wherein each hand rail support bar further comprises:

a bracket at an end of said hand rail support bar;

at least one aperture in said hand rail support bar bracket;

a plurality of apertures along a length of said horizontal support brace;

fastener means for extension through said vertical support bar bracket aperture and a selected aperture of said apertures along said horizontal support brace, whereby to adjust the relationship of each hand rail support bar along said horizontal support brace.

8. The system as claimed in claim 7 further comprising a plurality of brackets along said hand rail support bar, each bracket adapted to releasably engage a portion of a hand rail.

9. The system as claimed in claim 8 further comprising at least first and second brackets releasably engaged with said engaged hand rail; a strut; said brackets adapted to releasably engage said strut adjacent said hand rail to reinforce said hand rail.

10. A walkway system comprising:

first and second bracket assemblies for attachment to a building surface in a longitudinally displaced relationship therebetween, each of said bracket assemblies presenting a depending support member;

a horizontal support brace for providing underlying support to a walkway in extension along the building surface;

means for attaching said horizontal support brace at a position along a length of each said depending support member and in normal extension therefrom;

a vertical support member;

means for mounting said vertical support member at a selectable position along a length of each said horizontal support brace for placement of the walkway between said vertical support member and said depending support member and atop said horizontal brace;

at least one hand rail; and means on each said vertical support member for releasably engaging a portion of said at least one hand rail therein, wherein to present a hand rail vertically spaced from said walkway and adjacent one side thereof.

11. The system as claimed in claim 10 wherein said attaching means comprises:

a bracket at an end of each said horizontal support brace;

means for releasably attaching said horizontal support brace bracket to a portion of said depending support member.

12. The system as claimed in claim 11 wherein said releasable attaching means of said horizontal support bracket comprises:

a plurality of apertures along said depending support member;

at least one aperture in said bracket of said horizontal support brace; and fastener means extending through said bracket aperture and a selected aperture along said depending support.

13. The system as claimed in claim 10 wherein said vertical support mounting means comprises:

a bracket at an end of said vertical support member;

means for releasably attaching said vertical support bracket to a portion of said horizontal support brace.

14. The system as claimed in claim 13 wherein said releasable attaching means of said vertical support bracket comprises:

a plurality of apertures along said horizontal support brace;

at least one aperture in said bracket of said vertical support; and fastener means for extension through said vertical support bracket and a selected aperture along said horizontal support brace.

15. The system as claimed in claim 11 wherein said vertical support mounting means comprises:

a bracket at an end of said vertical support member;

means for releasably attaching said vertical support bracket to a portion of said horizontal brace.

16. The system as claimed in claim 15 wherein said releasable attaching means of said vertical support bracket comprises:

a plurality of apertures along said horizontal support brace;

at least one aperture in said bracket of said vertical support; and fastener means for extension through said vertical support bracket and a selected aperture along said horizontal support brace.

17. A walkway system comprising:

first and second bracket assemblies for attachment to a building structure each of said bracket assemblies presenting a support member upon said attachment;

means for releasably attaching said bracket assemblies to a building structure in a longitudinally spaced-apart relationship therebetween;

a horizontal support for an overlying walkway structure;

means for releasably attaching said horizontal support to each bracket assembly in a selectable position along a length of each bracket assembly support member;

at least one hand rail;

a pair of vertical support bars for said at least one hand rail;

means for releasably attaching one of said vertical hand rail support bars at a selectable position along a length of each horizontal support whereby to present a walkway bounded by at least one hand rail.

18. The system as claimed in claim 17 further comprising a strut; and support means releasably attached along said hand rail for positioning said strut adjacent the hand rail.

19. The system as claimed in claim 18 wherein said support means comprises a bracket, said bracket comprising:

a first hooked portion for engaging a top of said hand rail;

a second hooked portion attached to said first hook portion and presenting an underlying support for placement of said reinforcing strut therein and adjacent said hand rail.

20. The system as claimed in claim 17 further comprising a plurality of brackets along each said vertical support bar, each of said brackets engaging a portion of a separate hand rail therein.

21. The system as claimed in claim 10 further comprising:

a strut;

support means releasably attached along said hand rail for positioning said strut adjacent the hand rail to reinforce the same.

22. The system as claimed in claim 21 wherein said support means comprises a bracket, said bracket comprising:

a first hooked portion for releasably engaging a top of said hand rail;

a second hooked portion attached to said first hook portion and presenting an underlying support for placement of said strut therein and adjacent said hand rail.

* * * * *